US008197017B2

(12) United States Patent
Rahilly

(10) Patent No.: US 8,197,017 B2
(45) Date of Patent: Jun. 12, 2012

(54) ROTATING MULTI-LATCH RELEASE MECHANISM

(75) Inventor: Michael Rahilly, Encinitas, CA (US)

(73) Assignee: CareFusion 303, Inc., San Diego, CA (US)

( * ) Notice: Subject to any disclaimer, the term of this patent is extended or adjusted under 35 U.S.C. 154(b) by 344 days.

(21) Appl. No.: 12/506,173

(22) Filed: Jul. 20, 2009

(65) Prior Publication Data

US 2011/0012491 A1 Jan. 20, 2011

(51) Int. Cl.
*E05C 7/06* (2006.01)

(52) U.S. Cl. ..... 312/222; 312/328; 312/215

(58) Field of Classification Search ..... 312/109, 312/327, 328, 215–218, 222; 292/201, 144; 700/242; 221/151–154
See application file for complete search history.

(56) References Cited

U.S. PATENT DOCUMENTS

| | | | | |
|---|---|---|---|---|
| 3,608,341 | A * | 9/1971 | Galtz | 70/95 |
| 6,011,999 | A * | 1/2000 | Holmes | 700/231 |
| 6,175,779 | B1 * | 1/2001 | Barrett | 700/242 |
| 6,338,007 | B1 * | 1/2002 | Broadfield et al. | 700/231 |
| 7,040,504 | B2 * | 5/2006 | Broadfield et al. | 221/98 |
| 7,052,097 | B2 * | 5/2006 | Meek et al. | 312/222 |
| 7,142,944 | B2 * | 11/2006 | Holmes et al. | 700/237 |
| 7,426,425 | B2 * | 9/2008 | Meek et al. | 700/237 |
| 7,657,344 | B2 * | 2/2010 | Holmes et al. | 700/242 |
| 7,693,603 | B2 * | 4/2010 | Higham | 700/242 |
| 7,909,418 | B2 * | 3/2011 | McFarland | 312/215 |
| 8,019,470 | B2 * | 9/2011 | Meek et al. | 700/237 |
| 2009/0224638 | A1 * | 9/2009 | Weber | 312/209 |
| 2011/0101018 | A1 * | 5/2011 | Shafir | 221/1 |

* cited by examiner

*Primary Examiner* — Darnell Jayne
*Assistant Examiner* — Daniel Rohrhoff
(74) *Attorney, Agent, or Firm* — McDermott Will & Emery LLP

(57) ABSTRACT

A drawer that includes a container and an activation member is disclosed. The container includes a receptacle and a lid. The lid moves between an open position allowing access to the receptacle and a closed position restricting access to the receptacle. The container further includes a fastener, coupled to the lid, to fasten the lid to the receptacle when the lid is in the closed position. The activation member moves radially around a longest axis of the activation member, and includes an actuator. When the activation member is rotated in a first direction, the actuator is placed into a first orientation relative to the fastener. When the activation member is rotated in a second direction opposite the first direction, the actuator is placed into a second orientation relative to the fastener such that the actuator actuates the fastener to cause the lid to move into the open position.

13 Claims, 8 Drawing Sheets

ROTATING MULTI-LATCH RELEASE MECHANISM

BACKGROUND

1. Field

The present disclosure generally relates to apparatus and methods for controllably securing a container, and more particularly, to releasing a fastener of a container by rotational movement of an actuator.

2. Description of the Related Art

It is well known in the medical community, and in particular, in hospitals, to store medications in a centralized area or station for dispensing and administering the medications to patients. In the past, these stations were often unsecured, allowing access to unauthorized persons. There are several risks associated with unsecured and uncontrolled stations, such as the wrong type or amount of medication being administered to a patient (e.g., such as when medication is taken from an incorrect container in the station), the medication being stolen, or the mixing of medications.

Securable medication dispensing cabinets that seek to address these risks often contain complex mechanics in order to lock medication containers, which both reduce the amount of space in the cabinet to store medications, and increase the manufacturing cost of the cabinet. For example, many cabinets contain complex mechanics and motors attached to the cabinets themselves, and those mechanics and motors must then be interfaced with a drawer in order to provide access to compartments within the drawer, thereby reducing space in the cabinet for the drawer while at the same time providing additional constraints on use of the drawer.

SUMMARY

Drawers disclosed herein, according to certain embodiments, are independent from the cabinet in which they are housed because the drawers each include their own actuation mechanism. The actuation mechanisms are configured to actuate a latch release mechanism that provides access to containers within the drawer. The disclosed latch mechanisms allow for the efficient storage and dispensing of a large number of items within a given volume.

According to certain embodiments of the present disclosure, a drawer is provided. The drawer includes at least one container and an activation member. The at least one container includes a receptacle and a lid coupled to the receptacle, configured for movement between an open position allowing access to the receptacle and a closed position restricting access to the receptacle. The at least one container further includes a fastener, coupled to the lid, configured to fasten the lid to the receptacle when the lid is in the closed position. The activation member is configured to move radially around a longest axis of the activation member, and includes an actuator coupled to the activation member. When the activation member is rotated in a first direction, the actuator is placed into a first orientation relative to the fastener. When the activation member is rotated in a second direction opposite the first direction, the actuator is placed into a second orientation relative to the fastener such that the actuator actuates the fastener to cause the lid to move into the open position.

According to certain embodiments of the present disclosure, a cabinet is provided. The cabinet includes a plurality of drawers. Each drawer includes at least one container and an activation member. Each container includes a receptacle and a lid, coupled to the receptacle, configured for movement between an open position allowing access to the receptacle and a closed position restricting access to the receptacle. Each container also includes a fastener, coupled to the lid, configured to fasten the lid to the receptacle when the lid is in the closed position. The activation member is configured to move radially around a longest axis of the activation member. The activation member includes an actuator coupled to the activation member. When the activation member is rotated in a first direction, the actuator is placed into a first orientation relative to the fastener. When the activation member is rotated in a second direction opposite the first direction, the actuator is placed into a second orientation relative to the fastener such that the actuator actuates the fastener to cause the lid to move into the open position.

According to certain embodiments of the present disclosure, a method for accessing a container in a drawer is provided. The method includes rotating an activation member coupled to the drawer in a first direction around a longest axis of the activation member, thereby placing an actuator into a first orientation relative to a fastener of the container. The method also includes rotating the activation member in a second direction opposite the first direction, thereby placing the actuator into a second orientation relative to the fastener. The method further includes actuating the fastener with the actuator by continued rotation of the activation member in the second direction, thereby decoupling the fastener from the drawer and providing access to the container.

According to certain embodiments of the present disclosure, a drawer is provided. The drawer includes at least three containers and an activation member. Each container includes a receptacle, a lid, and a fastener. The lid is coupled to the receptacle, and configured for movement between an open position allowing access to the receptacle and a closed position restricting access to the receptacle. The fastener is coupled to the lid, and configured to fasten the lid to the receptacle when the lid is in the closed position. The activation member is configured to move radially around a longest axis of the activation member, and laterally along the longest axis between a first axial position and a second axial position. The activation member includes a first actuator coupled to the activation member at a first radial pitch, a second actuator coupled to the activation member at a different radial pitch than the first radial pitch, and a third actuator coupled to the activation member. When the activation member is in the first axial position and is rotated in a first direction, the first actuator is placed into a first orientation relative to the fastener of the first container. When the activation member is in the first axial position and is rotated in a second direction opposite the first direction, the first actuator is placed into a second orientation relative to the fastener of the first container such that the actuator actuates the fastener to cause the lid to move into the open position. Based on the different radial pitch, the second actuator is configured to actuate the fastener of the second container at a different orientation of the activation member than the first orientation and the second orientation. The first actuator and second actuator are configured to actuate the fastener of the first container and the fastener of the second container upon rotation of the activation member only when the activation member is in the first axial position. The third actuator is configured to actuate the fastener of the third container upon rotation of the activation member only when the activation member is in the second axial position.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the discussed embodiments as claimed.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

In the following detailed description, numerous specific details are set forth to provide a full understanding of the present disclosure. It will be obvious, however, to one ordinarily skilled in the art that the embodiments of the present disclosure may be practiced without some of these specific details. In other instances, well-known structures and techniques have not been shown in detail not to obscure the disclosure.

Certain embodiments of the drawer assembly disclosed herein provide a drawer in which the mechanical assemblies configured to open containers of the drawer are coupled to the drawer and independent from the cabinet containing the drawer. Consequently, the drawer's containers are configured to be accessible without requiring use of a motor in the cabinet in which the drawer is housed. Additionally, each drawer in the cabinet is mechanically independent from another drawer, such that even if the mechanical assemblies of one drawer fail, other drawers continue to function. The mechanical assemblies are particularly advantageous for providing access to individual containers within the drawer, which limits a user to accessing one container containing one item type at a time (e.g. "single line item dispensing"). This feature has special utility in a hospital or other patient care environment, where patient safety is improved by preventing a healthcare professional from accessing an incorrect medication. Advantages similar to those provided in the hospital environment can be found in other applications where controlled access is provided to items due to their high value or potential inappropriate use.

Figure 1:
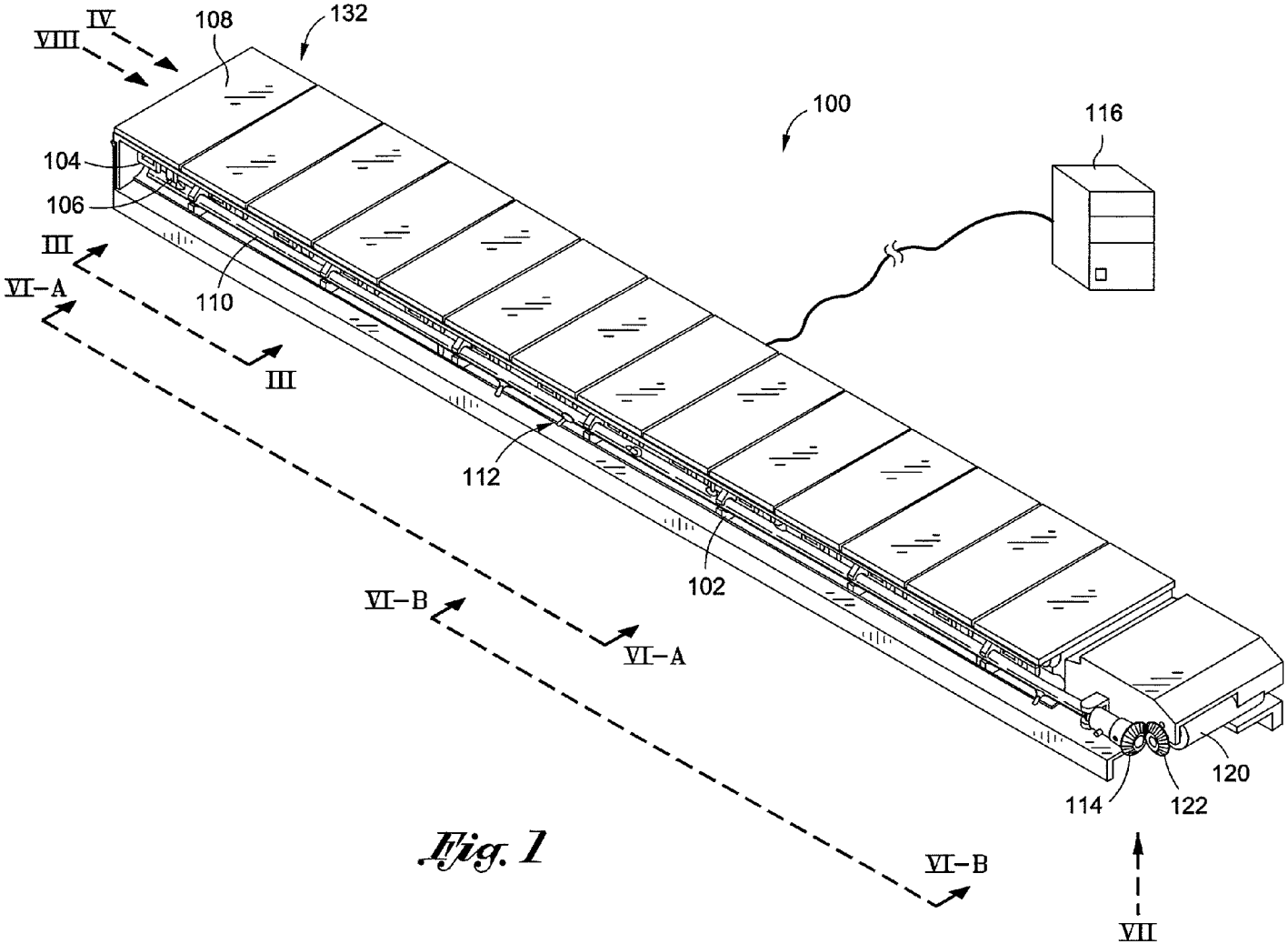
FIG. 1 illustrates a drawer according to certain embodiments.

FIG. 1 illustrates a drawer 100 according to certain embodiments. The drawer 100 includes a motor 120, an activation rod (or "activation member") 110, a housing 102 for the activation rod 110, and a plurality of containers 132. The activation rod 110 includes at least one actuation pin 112 (or "actuator"). Each of the containers 132 includes a receptacle (e.g., the four walls and floor of the container 132) and has a lid 108, a release lever 104, and an actuation lever 106 (the release lever 104 and the actuation lever 106 jointly form a "fastener" or "latch mechanism"). In certain embodiments, the drawer 100 is connected to a processor 116 (e.g., when the drawer 100 is housed in a cabinet), which is described in more detail below. The coupling of the lid 108 to the drawer 100 includes a spring (not illustrated) that biases the lid 108 towards an open position. The lid 108, however, remains in a closed position due to the coupling of the lid release lever 104 of the lid 108 with the drawer 100.

Vertical movement of the activation rod 110 is constrained at least in part by placement of the activation rod 110 in the housing 102. Radial movement of the activation rod 110 causes the activation pin 112 of the activation rod 110 to come into contact with the lid actuation lever 106. As will be discussed in further detail below, actuation of the lid actuation lever 106 by rotation of and contact with the activation pin 112 triggers the lid release lever 104 to release the lid 108 of the container 132, whereby the lid 108 biases open to the open position, thereby providing access to the container 132.

The lid release lever 104 is coupled to a spring or other bias member (504 in FIG. 5D) that biases the lid release lever 104 into a position substantially perpendicular to the longest axis of the activation rod 110. Similarly, the lid actuation lever 106 is coupled to a spring or other bias member (502 in FIG. 5D) that biases the lid actuation lever 106 into a position substantially perpendicular to the longest axis of the activation rod 110. In certain embodiments, the torsion force of the bias member 502 is greater than the torsion force associated with the activation rod 110. Consequently, if a force greater than the torsion force of the bias member 502 is not applied to the lid actuation lever 106, the lid actuation lever 106 maintains an orientation that is substantially perpendicular to the longest axis of the activation rod 110 (e.g., actuation lever 106 remains substantially vertical, as best illustrated in FIG. 3).

Figure 2:
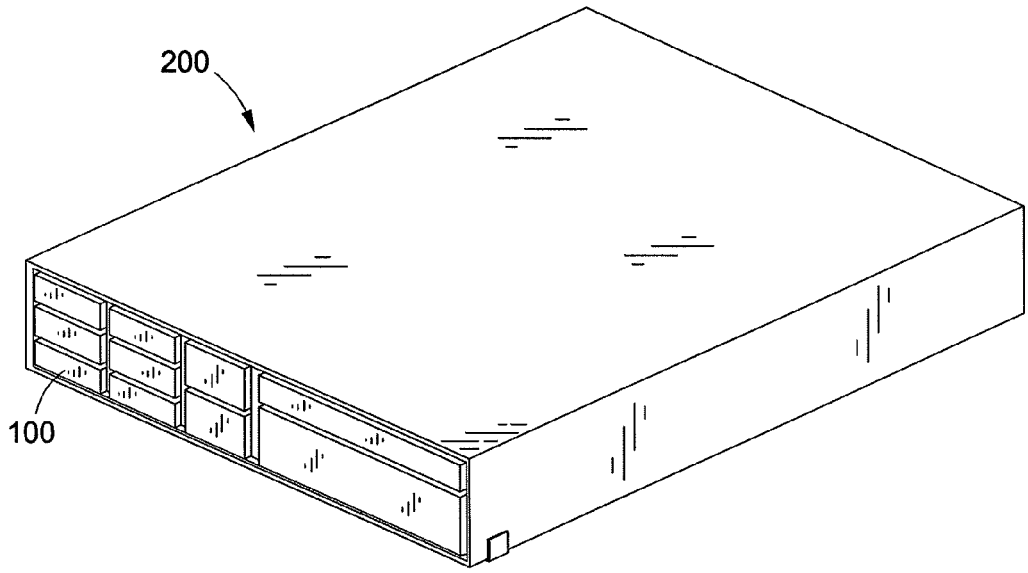
FIG. 2 illustrates a cabinet including the drawer of FIG. 1, according to certain embodiments.

The configuration of the drawer 100 is exemplary only, such that other physical configurations may be employed without departing from the scope of this disclosure. The drawer 100 is configured to be used in a cabinet 200. For example, the cabinet 200 can house a plurality of drawers 100 in any number of configurations, such as a cabinet 200 containing six drawers 100 as disclosed herein and four other drawers of various sizes as illustrated in FIG. 2. Other drawer configurations may be employed without departing from the scope of the disclosure.

Figure 3:
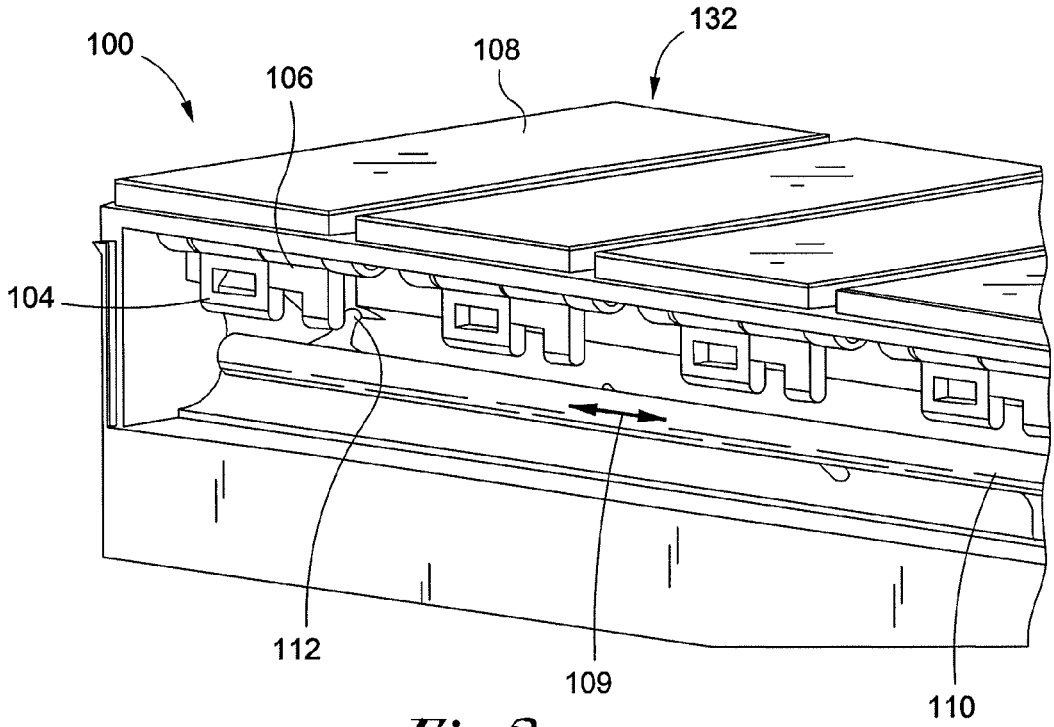
FIG. 3 is a side view in the direction of arrows III-III of FIG. 1, of a portion of the drawer of FIG. 1.
Figure 4:
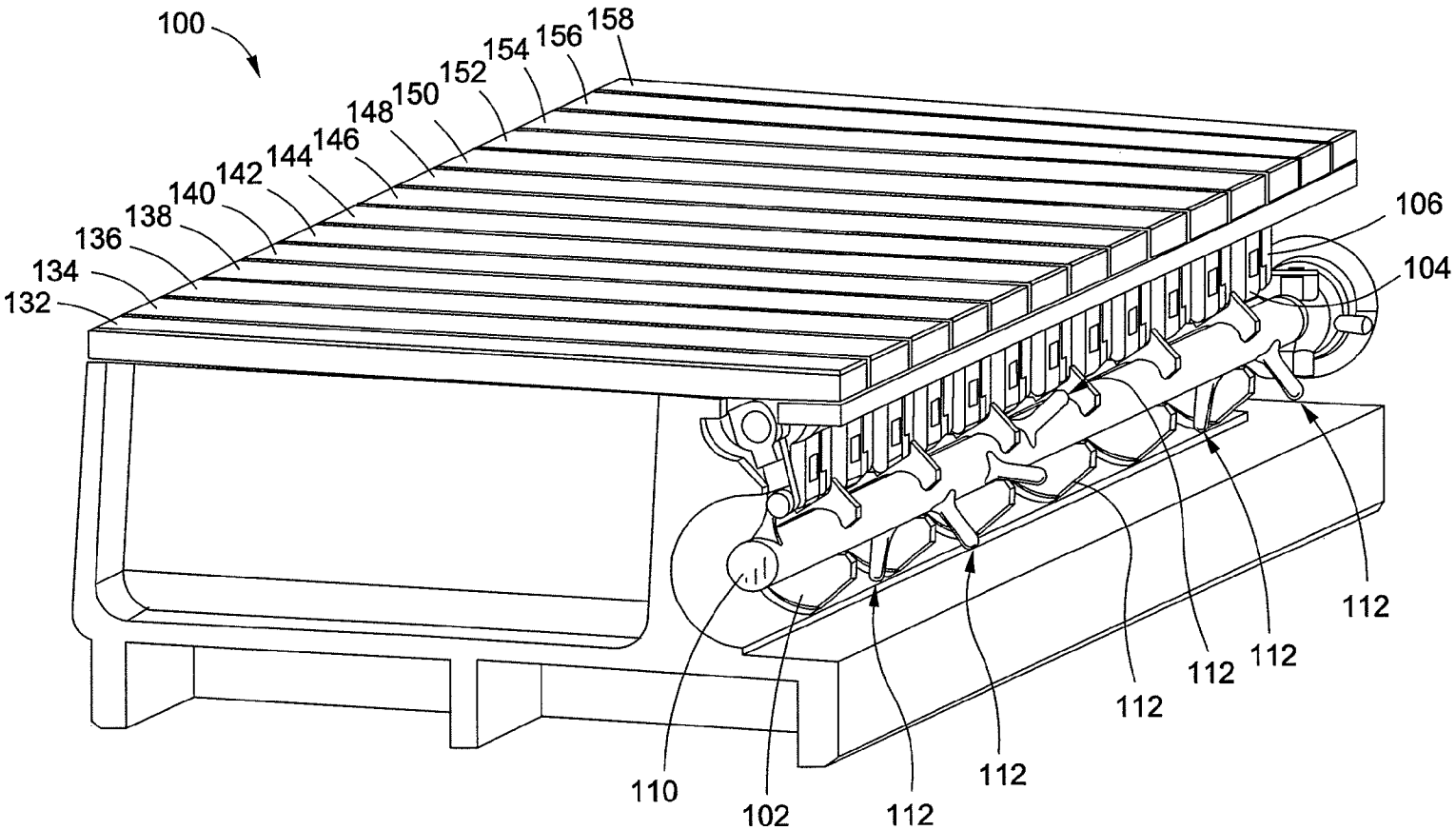
FIG. 4 is a front perspective view of the drawer of FIG. 1 in the direction of arrow IV of FIG. 1.

FIG. 3 illustrates, from a side view in the direction of arrows III-III of FIG. 1, the drawer 100 of FIG. 1. The activation rod 110 is configured to move radially around a longest axis 109 of the activation rod 110, and comprises at least one actuation pin 112 that is coupled to the activation rod 110. In certain embodiments, the activation rod 110 includes a plurality of actuation pins 112, as best illustrated in FIG. 4, a front view of the drawer 100 of FIG. 1 in the direction of arrow IV of FIG. 1. Each actuation pin 112 is coupled to the activation rod 110 at a different radial pitch, as illustrated, wherein each of the plurality of actuator pins 112 is configured to actuate the fastener 104 and 106 of an associated container 132 at different radial orientations of the activation rod 110. Consequently, when one actuator pin 112 actuates the fastener 104 and 106 of one container (e.g., container 132), another actuator pin 112 will not actuate the fastener 104 and 106 of another container (e.g., container 134), in the illustrated embodiments. In other embodiments, two or more actuator pins 112 can be coupled to the activation rod 110 with the same radial pitch to open two or more associated containers 132 as desired.

Figure 5A:
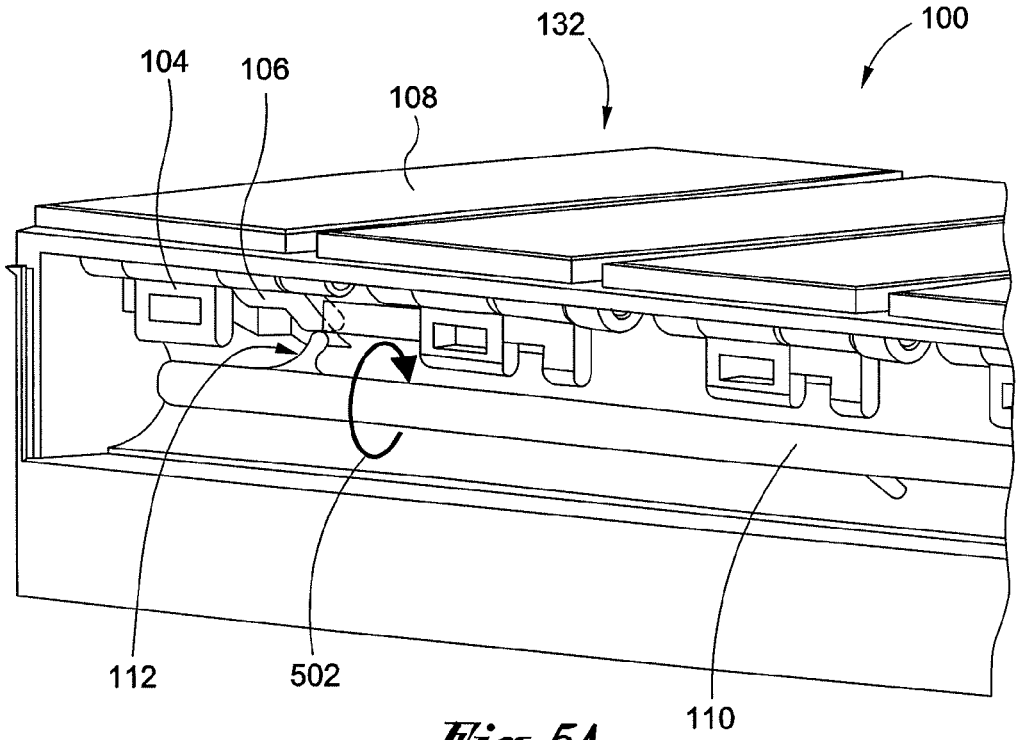
FIGS. 5A-5D illustrate, from a side view in the direction of arrows III-III of FIG. 1, various stages of the activation rod opening a lid of a container of the drawer of FIG. 1.
Figure 5B:
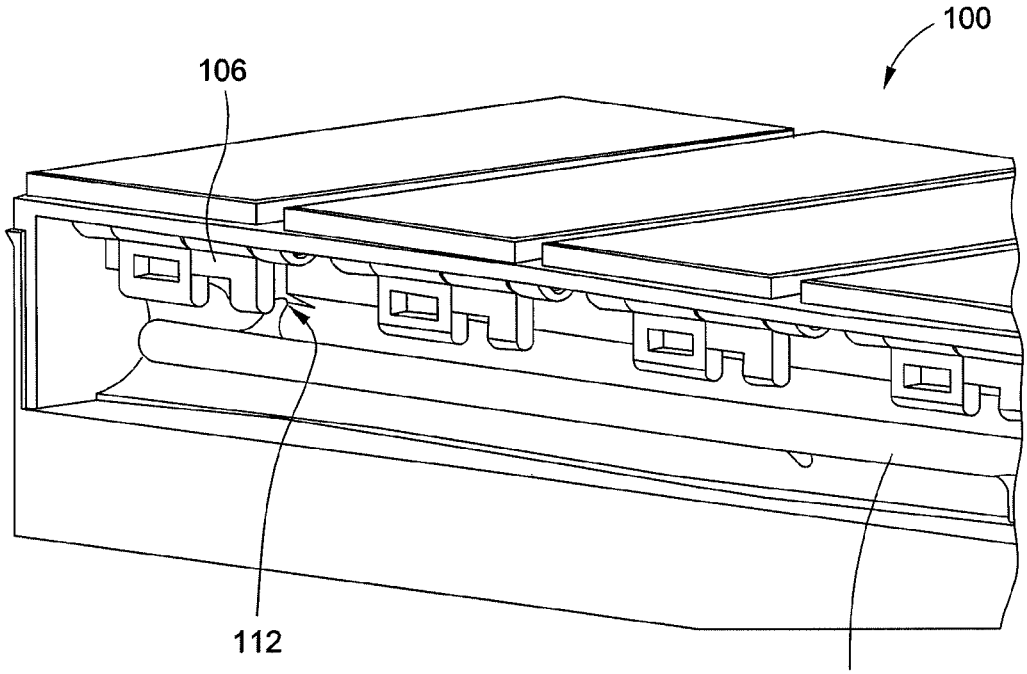

FIGS. 5A-5D illustrate, from a side view in the direction of arrows III-III of FIG. 1, various stages of the activation rod 110 opening a lid 108 of a container 132 of the drawer 100 of FIG. 1. In FIG. 5A, the activation rod 110 is rotated in a clockwise direction 502, causing the actuation pin 112 of the activation rod 110 to come in contact with and pass by the lid actuation lever 106, and move toward the container 132, thereby causing the lid actuation lever 106 to move in a counter-clockwise direction about its pivot. Movement of the lid actuation lever 106 in the counter-clockwise direction by the actuation pin 112 does not cause substantial movement of the lid release lever 104. As illustrated in FIG. 5B, once the actuation pin 112 has passed under the lid actuation lever 106 by continued clockwise movement of the activation rod 110, the lid actuation lever 106 returns to a substantially vertical position due to the torsion provided by an associated spring (not illustrated).

Figure 5C:
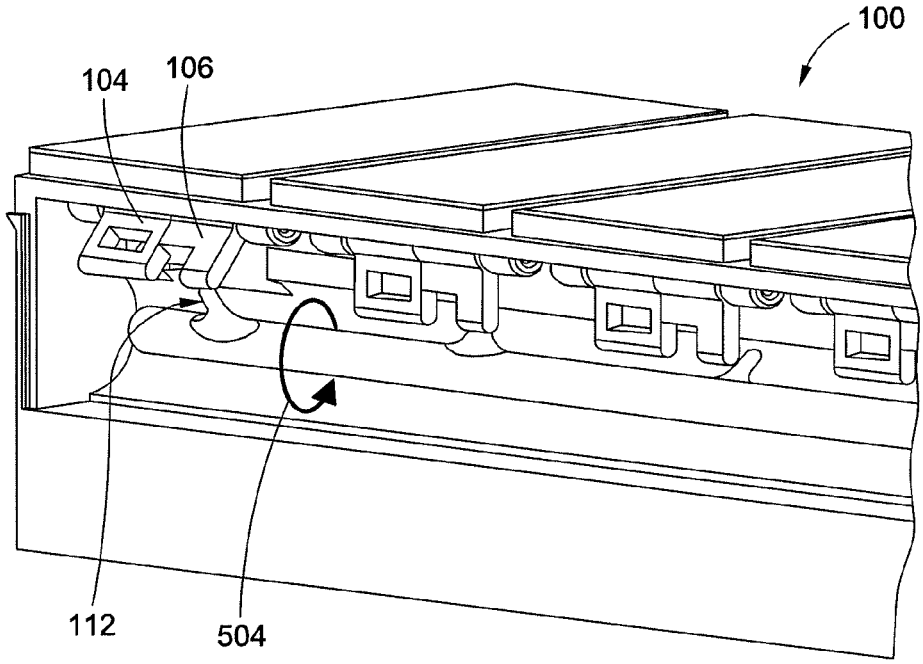
Figure 5D:
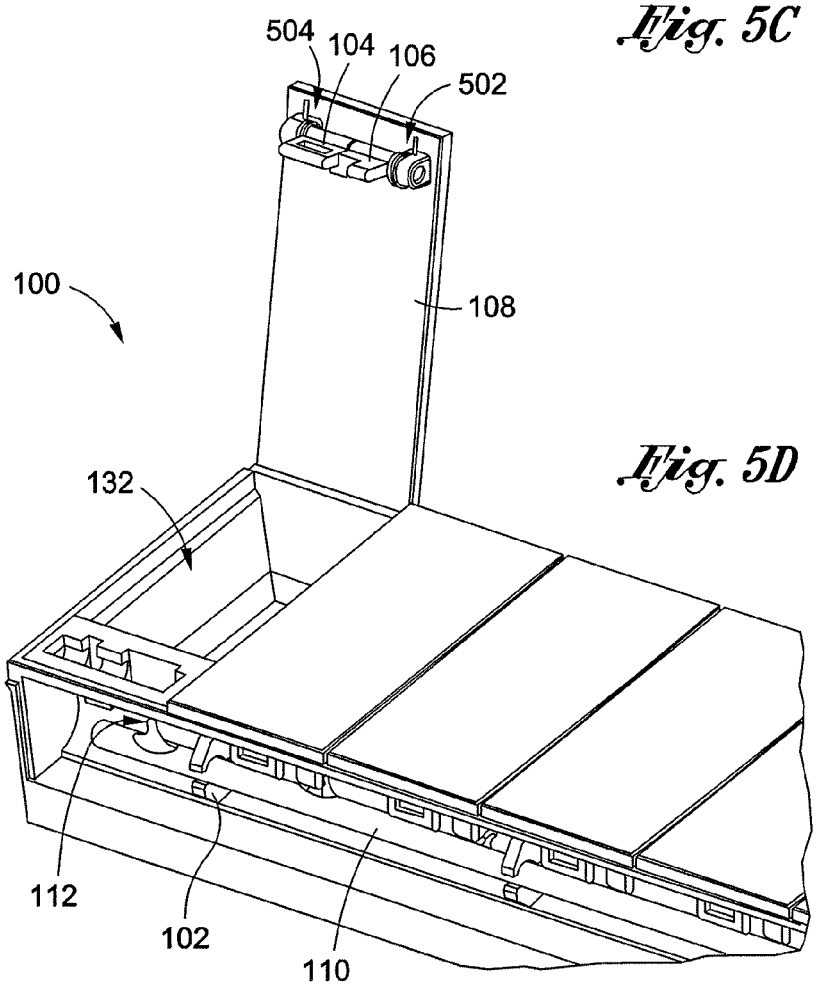

From a position in which the actuation pin 112 of the activation rod 110 is closer to the container 132, as illustrated in FIG. 5B, the activation rod 110 is rotated in the opposite, counter-clockwise direction 504, causing the actuation pin 112 of the activation rod 110 to come in contact with the opposite side of the lid actuation lever 106 to a position away from the container 132, thereby causing the lid actuation lever 106 to move in a clockwise direction about its pivot, as illustrated in FIG. 5C. Movement of the lid actuation lever 106 in the clockwise direction by the actuation pin 112 causes the lid release lever 104 to also move in the clockwise direction about its pivot along with the lid actuation lever 106 (e.g., by a tab protruding from a side of the lid actuation lever 106 proximal to the container 132 coming in contact with the lid release lever 104). Movement of the lid release lever 104 in the clockwise direction 504 triggers the lid release lever 104 to release the lid 108 of the container 132 (e.g., by decoupling the lid release lever from the fastener interface 802 of the drawer, described in further detail below with reference to FIGS. 8A-8C), whereby the lid 108 biases open to the open position, thereby providing access to the container 132, as illustrated in FIG. 5D.

Figure 6A:
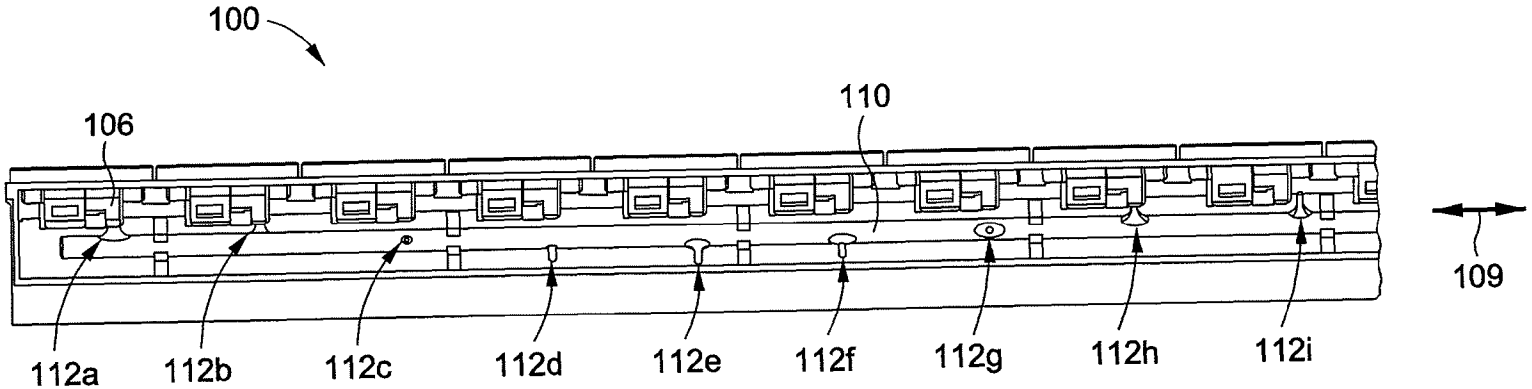
FIG. 6A illustrates, from a side view in the direction of arrows VIA-VIA of FIG. 1, the activation rod of the drawer of FIG. 1 in a first axial position.
Figure 6B:
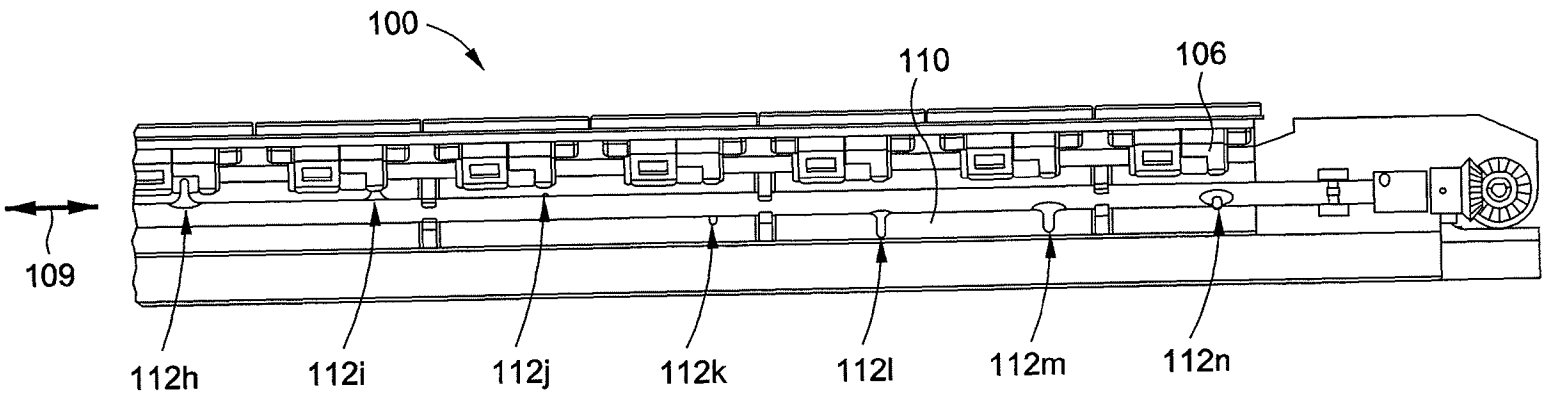
FIG. 6B illustrates, from a side view in the direction of arrows VIB-VIB of FIG. 1, the activation rod of the drawer of FIG. 1 in a second axial position.

FIG. 6A illustrates, from a side view in the direction of arrows VIA-VIA of FIG. 1, the activation rod 110 of the drawer 100 of FIG. 1 in a first axial position. FIG. 6B illustrates, from a side view in the direction of arrows VIB-VIB of FIG. 1, the activation rod 110 of the drawer 100 of FIG. 1 in a second axial position. The activation rod 110 is configured to move laterally along the longest axis 109 between the first axial position and the second axial position by a solenoid 702 (illustrated in FIG. 7). As illustrated in FIG. 6A, when the activation rod 110 is in the first axial position, an associated first set of actuation pins 112*a* to 112*h* are positioned along the longest axis 109 to come into contact with corresponding lid actuation levers 106 at an appropriate radial position of the activation rod 110, as described earlier. Actuator pins in a second set (e.g., actuator pin 112*i*-112*n*) are not configured to come into contact with corresponding lid actuation levers 106 when the activation rod 110 is in the first axial position. Similarly, as illustrated in FIG. 6B, when the activation rod 110 is in the second axial position, the associated first set of actuation pins (e.g., actuation pins 112*a*-112*h*) is configured to not come into contact with corresponding lid actuation levers 106 in any radial position of the activation rod 110. The actuator pins 112*i* to 112*n* in the second set are configured to come into contact with corresponding lid actuation levers 106 at an appropriate radial position of the activation rod 110, when the activation rod 110 is in the second axial position. This feature allows selective access to a set of containers associated with one set of actuator pins 112 without affecting access to containers associated with another set of actuator pins 112. The number of actuator pins 112 in each set may vary based at least in part on the radial configuration of the actuator pins in each set, and the number of containers 132 that are configured to be actuated by the actuation pins 112. The number of sets of actuator pins 112 and corresponding axial positions for an activation rod 110 may vary based at least in part on the length of the activation rod 110, the size of the containers 132 in the drawer, and the positioning of the lid release levers 104 and lid actuation levers 106.

Figure 7:
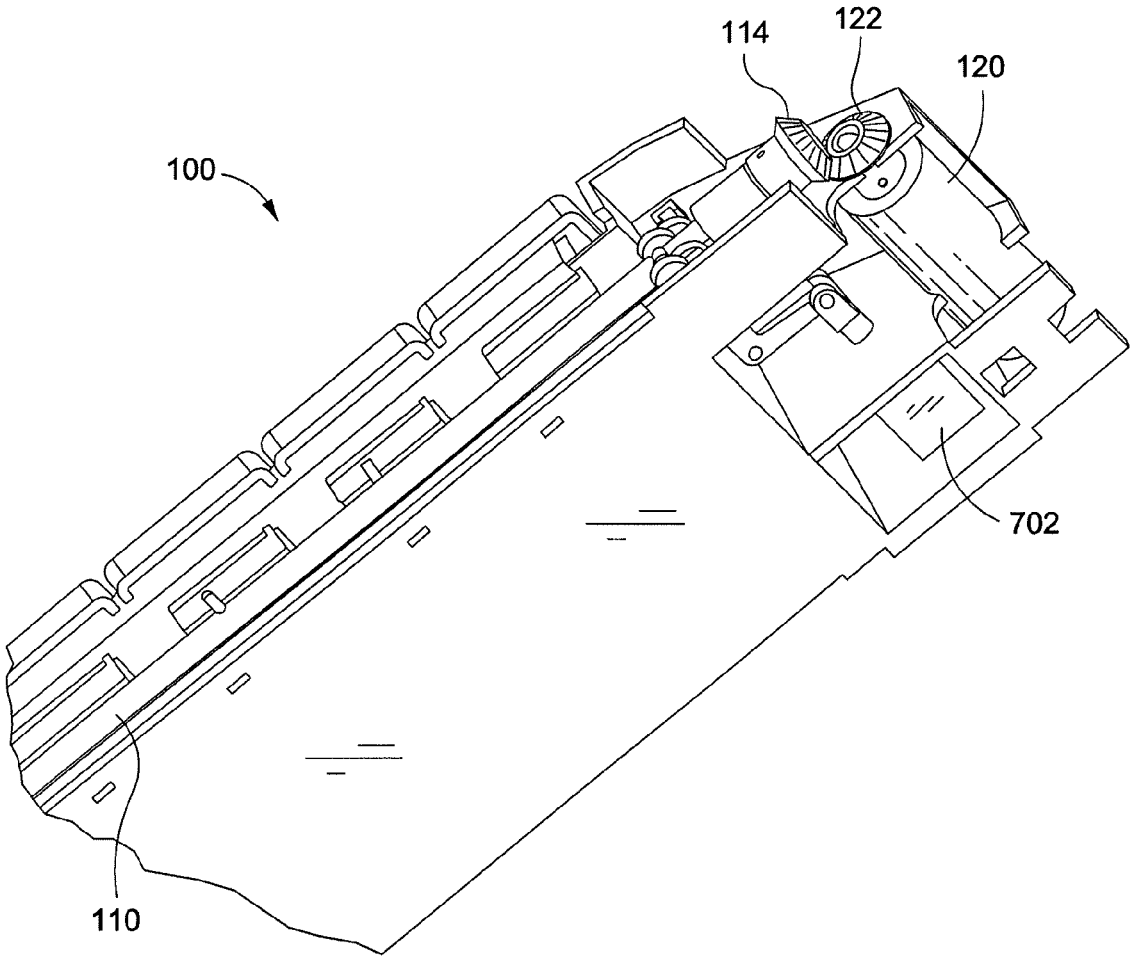
FIG. 7 is a bottom view of the motor of the drawer of FIG. 1 in the direction of arrow VII of FIG. 1.

FIG. 7 illustrates a bottom view of the motor 120 of the drawer 100 of FIG. 1 taken in the direction of arrow VII of FIG. 1. The motor 120 is coupled to a motor gear 122, and the motor gear 122 is coupled to the rod gear 114 of the activation rod 110. Rotational movement of the motor gear 122 by the motor 120 translates to radial movement of the rod gear 114, which causes the activation rod 110 to rotate, as described earlier.

The drawer 100 also includes a solenoid 702 configured to move the activation rod 110 between axial positions, as discussed above. In certain embodiments, another type of actuator can be configured to move the activation rod 110 between axial positions. As discussed above, appropriate rotation of the activation rod 110 will result in an actuation pin 112 of the activation rod 110 actuating the lid actuation lever 106 of a lid 108 of one of the containers 132, thereby providing access to one of the containers 132.

The motor 120 can be controlled by the processor 116 mentioned with reference to FIG. 1. Specifically, the motor 120 is electronically coupled to the computer system 116, which includes a processor configured to process instructions controlling activation of the motor 120 and appropriate circuitry to interface and control the motor 120. In addition to tracking the contents of the medication cabinet 200, the computer system 116 is configured to control access to the medication cabinet by authenticating a user, such as with a bar code scanner, fingerprint reader, or other form of identification input device. The motor 120 can be activated in response to appropriate authentication of the user.

Figure 8A:
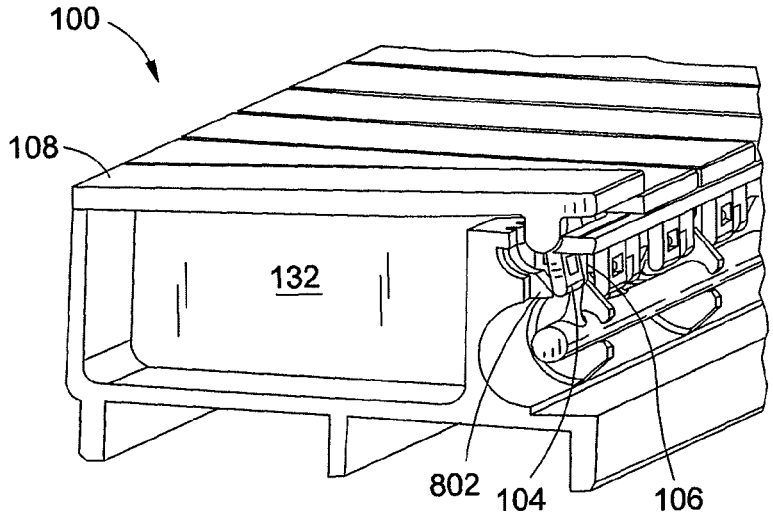
FIGS. 8A-8C illustrate, from a front perspective view of the drawer of FIG. 1 in the direction of arrow VIII of FIG. 1, coupling of the lid release lever to a fastener interface of the drawer.
Figure 8B:
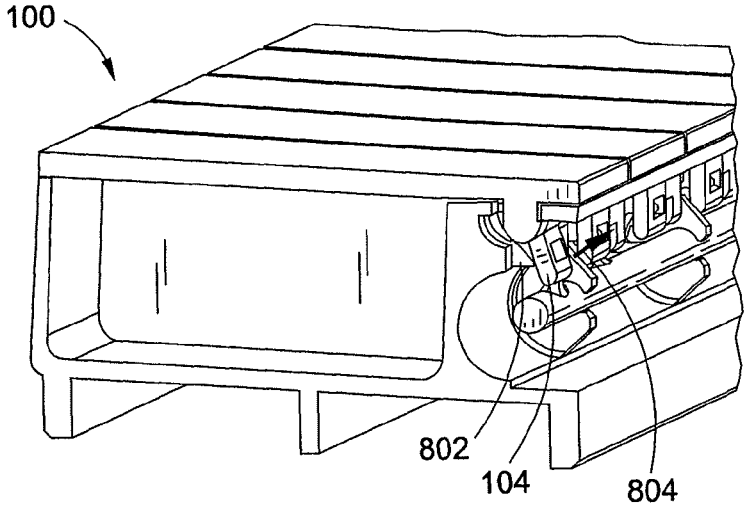
Figure 8C:
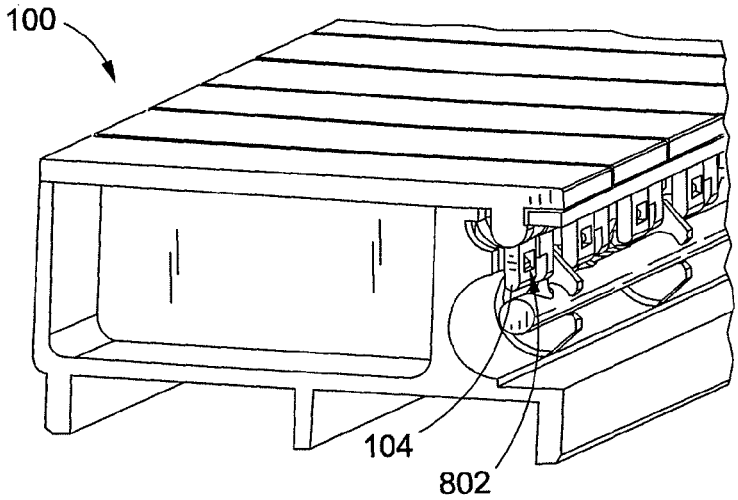

FIGS. 8A-8C illustrate, from a front perspective view of the drawer 100 of FIG. 1 in the direction of arrow VIII of FIG. 1, coupling of the lid release lever 104 to a fastener interface 802 of the drawer 100 to keep the lid 108 of the container 132 in a closed state. Specifically, as the lid release lever 104 of the lid 108 comes into contact with the fastener interface 802 of the drawer 100, as illustrated in FIG. 8A, the ramp-shaped surface of the fastener interface 802 causes the lid release lever 104 to move in an outward direction 804 as illustrated in FIG. 8B. The actuation lever 106 remains in substantially the same position. Once the lid release lever 104 passes the ramp-shaped surface of the fastener interface 802, as illustrated in FIG. 8C, the lid release lever 104 couples to the fastener interface 802, keeping the lid 108 of the container 132 in the closed state.

The embodiments of the present disclosure provide a low-cost latch release mechanism that provides access to restricted access containers of a drawer. The release mechanisms more efficiently use the limited space provided in the cabinet that houses the drawer, thereby providing more room to store items dispensed from the cabinet.

While certain aspects and embodiments of the invention have been described, these have been presented by way of example only, and are not intended to limit the scope of the invention. Indeed, the novel methods and systems described herein may be embodied in a variety of other forms without departing from the spirit thereof. The accompanying claims and their equivalents are intended to cover such forms or modifications as would fall within the scope and spirit of the invention.

What is claimed is:

1. A drawer comprising:

a first and a second receptacle;

a first and a second lid each coupled to the respective receptacle, the first and second lids each configured for movement between an open position allowing access to the respective receptacle and a closed position restricting access to the respective receptacle;

a first and a second fastener each coupled to the respective lid, the first and second fasteners each configured to fasten the lid to the respective receptacle when the lid is in the closed position;

an activation member comprising a longest axis, the activation member configured to rotate in a first direction about the longest axis and in a second direction opposite the first direction and to move along the longest axis between a first and a second axial position; and a first and a second actuator coupled to the activation member, wherein, when the activation member is rotated in the first direction, the first and second actuators are configured to not actuate the respective fasteners, and wherein, when the activation member is in the first axial position and rotated in the second direction, the first actuator actuates the first fastener so as to allow the first lid to move into the open position, and wherein, when the activation member is in the second axial position and rotated in the second direction, the second actuator actuates the second fastener so as to allow the second lid to move into the open position.

2. The drawer of claim 1, wherein:

the second actuator is coupled to the activation member at a different radial pitch than the first actuator;

the first actuator is configured to actuate the first fastener at a first orientation of the activation member; and the second actuator is configured to actuate the second fastener at a second orientation of the activation member that is different from the first orientation.

3. The drawer of claim 2, further comprising a plurality of actuators coupled to the activation member at different radial pitches, wherein each of the plurality of actuators is configured to actuate a respective fastener at different orientations of the activation member.

4. The drawer of claim 1, wherein each of the fasteners comprises a bias member comprising a first torsion strength greater than a torsion strength associated with the activation member.

5. The drawer of claim 4, wherein the bias member is configured to position the fastener to be substantially perpendicular to the longest axis of the activation member.

6. The drawer of claim 1, wherein a first end of the activation member comprises a gear, the gear configured to rotate the activation member about the longest axis.

7. The drawer of claim 6, further comprising a motor coupled to the gear and configured to actuate the gear, thereby rotating the activation member about the longest axis.

8. A cabinet comprising:

at least one drawer comprising a first and a second receptacle;

a first and a second lid each coupled to the respective receptacle, the first and second lids each configured for movement between an open position allowing access to the respective receptacle and a closed position restricting access to the respective receptacle;

a first and a second fastener each coupled to the respective lid, the first and second fasteners each configured to fasten the lid to the respective receptacle when the lid is in the closed position;

an activation member comprising a longest axis, the activation member configured to rotate in a first direction about the longest axis and in a second direction opposite the first direction and to move along the longest axis between a first and a second axial position; and a first and a second actuator coupled to the activation member, wherein, when the activation member is rotated in the first direction, the first and second actuators are configured to not actuate the respective fasteners, and wherein, when the activation member is in the first axial position and rotated in the second direction, the first actuator actuates the first fastener so as to allow the first lid to move into the open position, and wherein, when the activation member is in the second axial position and rotated in the second direction, the second actuator actuates the second fastener so as to allow the second lid to move into the open position.

9. A method for accessing one container in a drawer comprising at least first and second containers, the method comprising the steps of:

rotating an activation member coupled to the drawer in a first direction about a longest axis of the activation member, thereby placing a first and a second actuator into a first orientation relative to a first and a second fastener of the respective first and second containers;

moving the activation member along the longest axis to a first axial position;

rotating the activation member in a second direction opposite the first direction, thereby placing the first actuator into a second orientation relative to the first fastener while not placing the second actuator in the second orientation relative to the second fastener; and actuating the first fastener with the first actuator by continued rotation of the activation member in the second direction while not actuating the second fastener with the second actuator, thereby providing access to the first container without providing access to the second container.

10. The method of claim 9, further comprising the steps of:

rotating the activation member in the second direction, thereby placing the second actuator into the second orientation relative to the second fastener; and actuating the second fastener with the second actuator by continued rotation of the activation member in the second direction, thereby providing access to the second container.

11. The method of claim 9, further comprising:

moving the activation member along the longest axis from a first axial position to a second axial position;

rotating the activation member coupled to the drawer in the first direction around the longest axis, thereby placing the second actuator into the first orientation relative to a fastener of another container, and placing the first actuator into another orientation relative to the first fastener, the other orientation configured to avoid actuation of the first fastener;

rotating the activation member in the second direction, thereby placing the second actuator into the second orientation relative to the fastener of the other container; and actuating the fastener of the other container with the second actuator by continued rotation of the activation member in the second direction, thereby providing access to the other container.

12. The method of claim 11, wherein the first actuator is configured to actuate the first fastener only when the activation member is in the first axial position, and wherein the second actuator is configured to actuate the fastener of the other container only when the activation member is in the second axial position.

13. A drawer comprising:

at least three containers, each container comprising:

a receptacle;

a lid coupled to the receptacle, and configured for movement between an open position allowing access to the receptacle and a closed position restricting access to the receptacle; and a fastener, coupled to the lid, and configured to fasten the lid to the receptacle when the lid is in the closed position; and an activation member comprising a longest axis, the activation member configured to rotate in a first direction about the longest axis and in a second direction opposite the first direction and to move along the longest axis between a first axial position and a second axial position;

a first actuator coupled to the activation member at a first radial pitch;

a second actuator coupled to the activation member at a different radial pitch than the first radial pitch; and a third actuator coupled to the activation member;

wherein, when the activation member is in the first axial position and is rotated in a first direction, the first actuator is placed into a first orientation relative to the fastener of the first container, and wherein, when the activation member is in the first axial position and is rotated in a second direction opposite the first direction, the first actuator is placed into a second orientation relative to the fastener of the first container such that the actuator actuates the fastener to cause the lid to move into the open position, wherein, based on the different radial pitch, the second actuator is configured to actuate the fastener of the second container at a different orientation of the activation member than the first orientation and the second orientation, wherein the first actuator and second actuator are configured to actuate the fastener of the first container and the fastener of the second container upon rotation of the activation member only when the activation member is in the first axial position, and wherein the third actuator is configured to actuate the fastener of the third container upon rotation of the activation member only when the activation member is in the second axial position.

* * * * *